United States Patent [19]

Anderson

[11] Patent Number: 4,475,706

[45] Date of Patent: Oct. 9, 1984

[54] OVERHEAD MOUNTING BRACKET FOR A HORIZONTAL VENETIAN BLIND ASSEMBLY

[75] Inventor: Richard N. Anderson, Owensboro, Ky.

[73] Assignee: Hunter Douglas Inc., Totowa, N.J.

[21] Appl. No.: 325,543

[22] Filed: Nov. 27, 1981

[51] Int. Cl.[3] ..... E06B 9/38

[52] U.S. Cl. ..... 248/542; 248/544; 248/251; 160/178 R; 16/94 R

[58] Field of Search ..... 248/542, 544, 261, 262, 248/251, 263; 160/168, 178 R, 181, 178 B, 176 B; 16/94 R, 94 D; 52/127

[56] References Cited

U.S. PATENT DOCUMENTS

| | | | |
|---|---|---|---|
| 4,135,692 | 1/1979 | Ferguson | 248/544 |
| 4,224,974 | 9/1980 | Anderson | 160/178 R |
| 4,384,605 | 5/1983 | Schaeffer | 160/178 R |

*Primary Examiner*—William H. Schultz
*Assistant Examiner*—Robert A. Olson
*Attorney, Agent, or Firm*—Pennie & Edmonds

[57] ABSTRACT

An overhead mounting bracket for a horizontal venetian blind assembly having a U-shaped headrail including inturned ends forming return ribs. The bracket has first and second leg portions depending from a body portion where the leg portions include horizontal support shelves adapted to support the return ribs of a headrail. Decoupler means comprising a pivotal portion are included for spreading the legs of the headrail apart so that a return rib may clear a shelf upon disengagement of the headrail from the bracket.

6 Claims, 10 Drawing Figures

OVERHEAD MOUNTING BRACKET FOR A HORIZONTAL VENETIAN BLIND ASSEMBLY

FIELD OF THE INVENTION

The invention relates to an overhead mounting bracket for a horizontal venetian blind assembly and more particularly to a bracket which may be easily engaged with or disengaged from a headrail of the blind assembly.

CROSS-REFERENCE TO OTHER APPLICATIONS

Application Ser. No. 236,726 filed Feb. 23, 1981 by the same applicant relates to a headrail mounting bracket also utilized for mounting horizontal venetian blind assemblies.

BACKGROUND OF THE INVENTION

Horizontal venetain blind assemblies are often mounted to ceiling or wall structure by way of a headrail which contains a tilt rod for tilting the slats of the blind and mechanisms for raising and lowering the slats. The connection between the ceiling or wall structure and the headrail may conventionally be by way of brackets which fit over the ends of the headrail. The brackets themselves are often made of metal stampings comprising a number of separate parts which then must be assembled together by riveting or other means resulting in a relatively expensive component.

Since the bracket overlaps a portion of the headrail, it is readily observable and may present a color contrast with a headrail if it is of a different color than the headrail. In order to assure that there is no color contrast, a large inventory of brackets must be maintained to accommodate the various headrail colors that may be used in venetian blind installations.

Further the use of brackets which extend over the outer periphery of the headrail results in a space between the ceiling and the top of the headrail when the headrail is installed which is objectionable since it creates an unsightly gap.

Many conventional brackets further must be manufactured with close manufacturing tolerances to assure a tight fit to prevent rattling of the headrail. Manufacture of the bracket and the headrail to tight tolerances necessarily increases the cost of manufacture both in parts produced and in the cost of tool design making the parts.

It is therefore an object of my invention to provide for a headrail bracket which is applicable for use with horizontal venetian blind assemblies and which will overcome the aforementioned difficulties.

GENERAL DESCRIPTION OF THE INVENTION

Broadly an overhead mounting bracket for a horizontal blind assembly constructed according to my invention is adapted for use with a substantially U-shaped headrail where the ends of the U-shaped headrail each have an inturned rounded end to form a return rib. The bracket itself has a body portion and first and second oppositely disposed leg portions depending from the body portion and which are fixed with respect to each other. Each leg portion has an outwardly horizontally extending support shelf adapted to support a return rib. A resilient decoupling means is provided and is adapted to engage and force the return ribs of the legs of the headrail apart for disengagement of a headrail from the bracket in order that a return rib may be moved horizontally beyond a support shelf after which a headrail may be rotated to clear both support shelves.

The decoupling means comprises a horizontally extending pivotal portion which extends horizontally beyond the support shelf of one leg portion and is connected at one end to the other leg portion. The pivotal portion has a disengaging face on the opposite end thereof from the end connected to the leg with the disengaging face being adapted to engage a return rib upon disengagement of a headrail from a bracket to force the rib outwardly of the U-shaped headrail. Preferably the disengaging face has a tapered portion at a lower end thereof adapted to initially engage a return rib when a headrail is forced into contact with a decoupling means upon disengagement of the headrail from the bracket.

The horizontally extending pivotal portion is provided with means for limiting pivotal movement which preferably comprises a vertically extending slot in the pivotal portion below its pivot axis whereby when the pivotal portion is pivoted downwards, the sides of the slot will be squeezed together to prevent further pivotal movement. Two horizontally extending pivotal portions may be provided, one on either side of the body portion of the bracket.

The depending leg portions have tapered faces on their bottom surfaces for initially engaging the return ribs of the headrail to spread the ribs apart when a headrail is being applied to the bracket in order that the return ribs may be forced horizontally outwardly beyond the support shelves.

The bracket itself preferably is made by a molding process using a die cast plastic and in one unitary piece to reduce cost of manufacture. The bracket fits substantially entirely within the confines of a U-shaped headrail so that no portion extends beyond the front of the headrail to present an unsightly appearance. This means that the bracket may be of any color since, at most, only a small portion of the bracket will show between the top of the headrail and ceiling, thus reducing inventory requirements and of maintaining brackets of the same color as the headrail with which they are to be used.

BEST MODE FOR CARRYING OUT THE INVENTION

Figure 1:
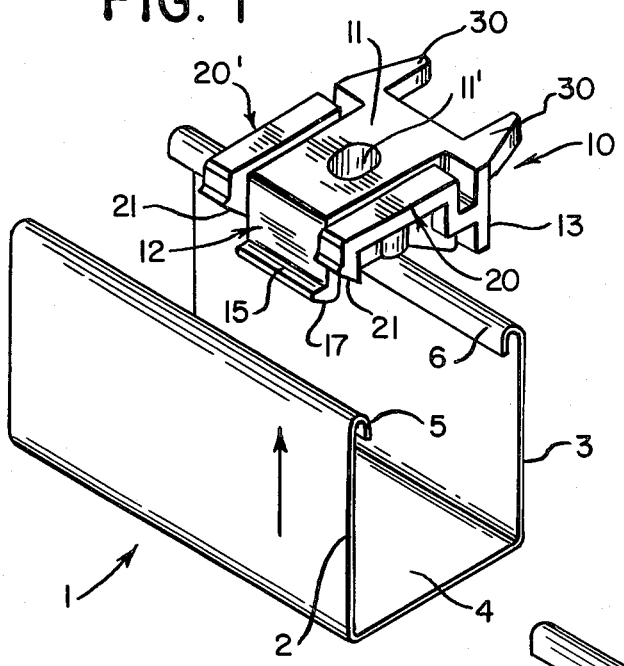
FIG. 1 is a perspective view of an overhead mounting bracket constructed according to the invention and of a headrail prior to mounting of the headrail on the bracket.

Referring to FIG. 1, there is illustrated a headrail 1 being applied to a bracket 10 constructed according to the invention. The headrail 1 is of a conventional consturction and comprises a U-shaped channel member having vertically extending legs 2 and 3 joined by a horizontal web 4. The ends of the legs 2 and 3 are turned inwardly of the headrail to form return ribs 5 and 6.

Figure 6:
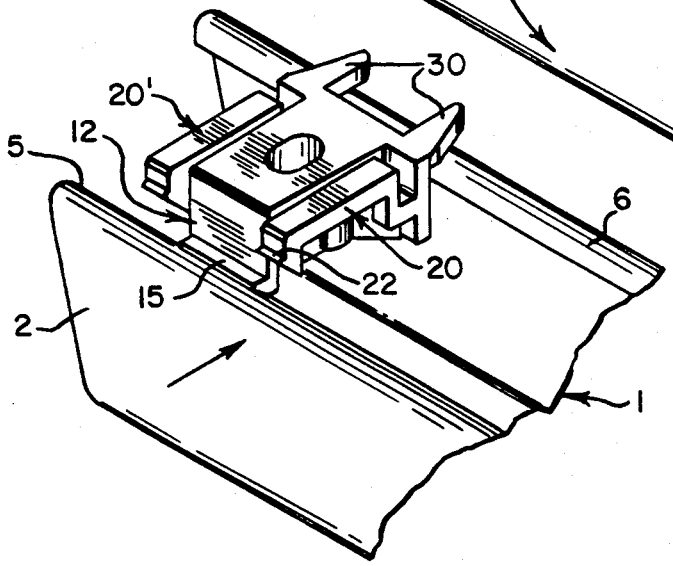
FIG. 6 is a view similar to FIG. 5 illustrating still further disengagement of the headrail from the bracket.
Figure 7:
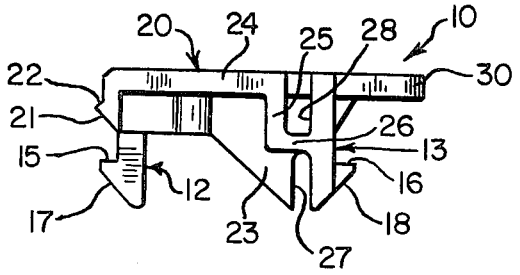
FIG. 7 is an end elevational view of the bracket of FIG. 1.
Figure 8:
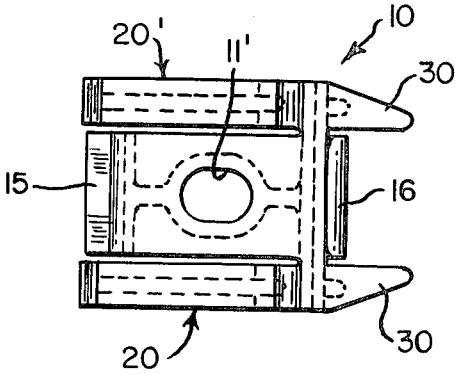
FIG. 8 is a plan view of the bracket of FIG. 1.
Figure 9:
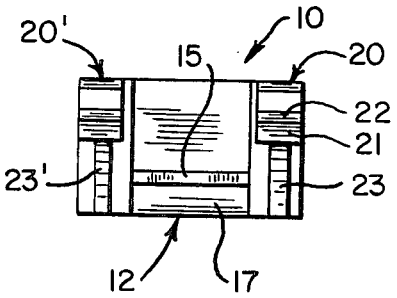
FIG. 9 is a front elevational view of the bracket of FIG. 1.
Figure 10:
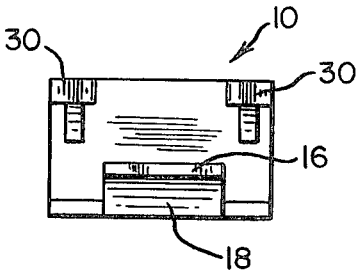
FIG. 10 is a rear elevational view of the bracket of FIG. 1.

The bracket 10 comprises a horizontally extending body portion 11 having a first leg portion 12 depending therefrom on the front side of the bracket and a second oppositely disposed leg portion 13 depending from the body portion on the rear side of the bracket. The body portion is provided with a hole 11' which serves as a mounting means for the bracket and through which a screw or other fastening means be inserted in order to mount the bracket to a ceiling or window frame member. Leg portions 12 and 13 are fixed relative to each other. As shown in FIGS. 6 and 7, the leg portion 12 has a horizontally extending support shelf 15 extending outwardly of the bracket while the leg portion 13 has a horizontally extending support shelf 16 also extending outwardly the the bracket. Support shelves 15 and 16 are adapted to engage with the ends of return ribs 5 and 6 of a headrail to support the same upon mounting of a headrail on the bracket.

Both leg portions 12 and 13 are provided with tapered faces 17 and 18 at their lower ends which serve to force return ribs 5 and 6 apart when a headrail 1 is forced into contact with the legs.

Figure 2:
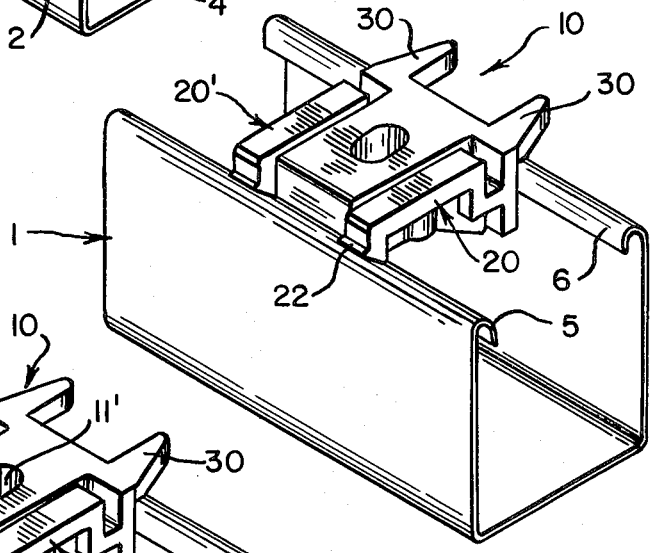
FIG. 2 is a view similar to FIG. 1 with the headrail mounted on the bracket.

A headrail is mounted to a bracket, as shown in FIG. 1, by moving the headrail vertically upwards in the direction of the arrow until the tapered faces 17 and 18 engage the inner rounded surfaces of the return ribs 5 and 6. Further upward movement of the headrail will then cause the leg portions 2 and 3 to spread outwardly until the ends of the return ribs may snap over the outer edges of the support shelves 15 and 16. At this point the leg portions will spring inwardly of the headrail so that the ends of the return ribs will be supported by the shelves and the headrail will be mounted on the bracket as shown in FIG. 2.

The bracket also includes at least one resilient or flexible decoupling means by which the headrail may be disengaged from the bracket. The decoupling means comprises a horizontally extending pivotal portion 20 on one side of the body portion 11 and which, as shown in FIG. 7, extends horizontally slightly beyond shelf 15 of first leg portion 12.

The pivotal portion 20 has an outwardly tapered disengaging face 21 on the end thereof which joins with an inwardly tapered surface 22 such that the apex between the tapered face and tapered surface forms a catch adapted to engage the end of the return rib 5 as explained further hereafter.

As shown in FIG. 7, pivotal portion 20 is connected to the second leg portion 13 by a web 23 including flanges 24, 25 and 26. A slot 27 is included in the web 23 below the flange 26 while a slot 28 is included above the flange 26. The slots 27 and 28 thus result in flange 26 and the portion of the web adjacent flange 26 forming a small resilient or flexible connection of the pivotal portion 20 with the second leg portion 13. The slot 27 further serves as a means for limiting downward pivotal movement of portion 20. That is to say, when the side of slot 27 engage each other, further downward movement of web 23 and pivotal portion 20 will be prevented.

The body portion 11 preferably has a further decoupler means comprising pivotal portion 20' positioned on the opposite side of the body portion 11 than pivotal portion 20. The construction of this further decoupler means is identical with that incorporating pivotal portion 20.

The body portion has ears 30 which are adapted to extend beyond the rear of the bracket to engage a wall such that the ears serve as spacers to assist in aligning the bracket with a wall to provide proper spacing of a head-rail from a wall.

Figure 3:
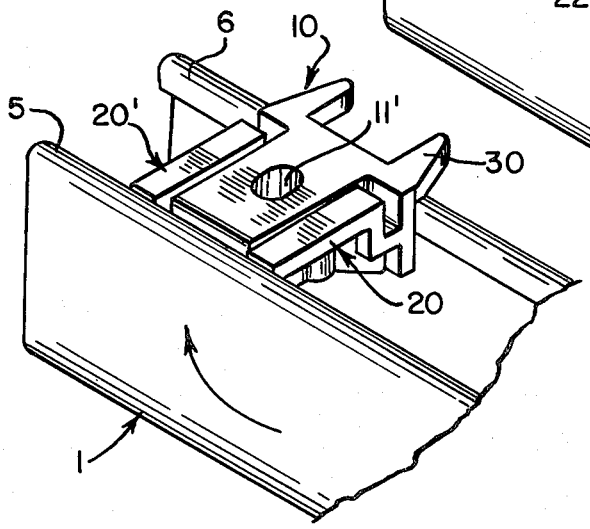
FIG. 3 is a view similar to FIG. 2 illustrating initial movement of a headrail in disengaging the headrail from the bracket.

The headrail 1 is removed from the mounted position on bracket 10 as shown in FIG. 2 as follows. In a first method of disengagement as shown in FIG. 3, the side of the headrail next to the disengagement face 21, which is normally the front side of the headrail is pushed upwardly such that the disengaging face contacts return rib 5 forcing leg 2 to bend outwardly of the headrail. Further upward movement will cause the end of the return rib 5 to pass over the apex between face 21 and surface 22 of the pivotal portion after which the leg 2 will spring inwardly of the headrail whereby the end of the return rib 5 will engage surface 22.

Figure 5:
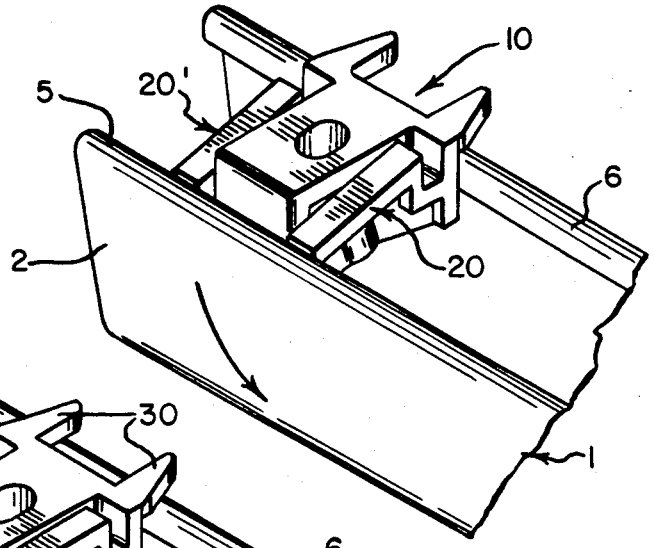
FIG. 5 is a view similar to FIGS. 3 and 4 illustrating further disengagement of the headrail from the bracket.

The headrail is then rotated downwardly in the direction of the arrow as shown in FIG. 5 such that the return rib 5 clears shelf 15. This occurs because the pivotal portion 20 extends horizontally beyond the end of the shelf 15 thus holding rib 5 beyond the shelf. Rotation of the headrail is continued until rib 5 is below shelf 15. At this point further pivoting of the portion 20 is prevented by the sides of slot 27 engaging each other. Also at this point surface 22 is substantially vertical which will allow the return rib 5 to fall and release from the surface after which the pivotal portion will spring back to a horizontal position. The headrail is then moved towards the leg portion 13 as shown in FIG. 6 allowing the return rib 6 to be released from shelf 16.

Figure 4:
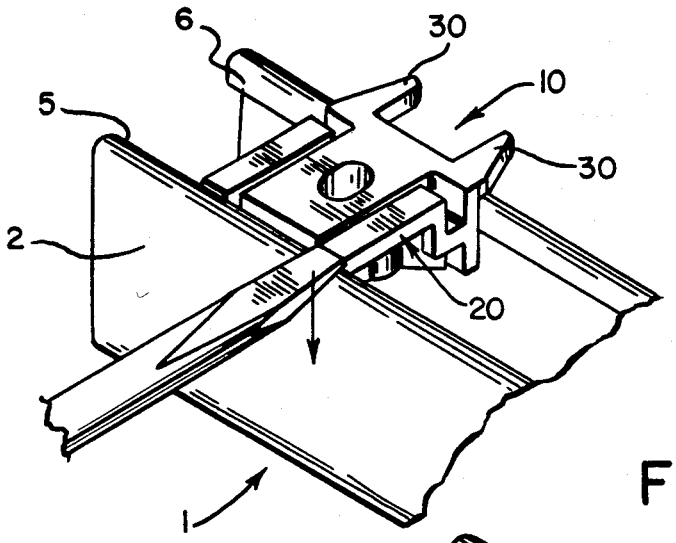
FIG. 4 is a view similar to FIG. 3 illustrating an alternate mode of initially disengaging the headrail from the bracket.

An alternate method of disengagement is shown in FIG. 4. Instead of moving the headrail upwardly as shown in FIG. 3, a screwdriver or other tool is inserted into the gap between the top of the return rib 5 and the ceiling. The decoupler means comprising the pivotal portion 20 is depressed such that the face 21 forces the leg 5 and rib outwardly of the headrail. Continued depression of the pivotal portion will cause the end of the rib 5 to ride over the apex between face 21 and surface 22 such that the end of the rib is caught onto surface 22 in the same manner as described in the first method of disengagement. The headrail is then moved downwards and removed from the bracket in the manner described with respect to FIGS. 5 and 6.

While the decoupler means comprising the pivotal portions 20 and 20' are shown as being integral with the body portion 11, they could be separate and independently pivotally moved onto a ceiling or similar frame member.

I claim:

1. An overhead mounting bracket for a horizontal venetian blind assembly including a substantially U-shaped headrail with the ends of the leg of the U-shaped headrail each having an inturned end to form a return rib, said bracket comprising a body portion, and first and second oppositely disposed leg portions depending from said body portion and fixed with respect to each other, each leg portion having a horizontally extending support shelf adapted to support a return rib, characterized in that said bracket has a resilient decoupler means on said body portion adapted to locally engage one return rib of a headrail prior to disengagement of a headrail from the bracket and force and hold said one return rib remote from a position in which said one return rib is supported by the support shelf of the first leg portion to allow said one return rib to pass the support shelf of the first leg portion during subsequent disengagement of the headrail.

2. An overhead mounting bracket according to claim 1 further characterized in that said decoupler means comprises a substantially horizontally extending pivotal portion extending horizontally beyond the support shelf of the first leg portion and being connected at one end to said second leg portion and having a disengaging face on a free end thereof opposite the end connected to said second leg portions, said disengaging face being adapted to engage a return rib prior to disengagement of a headrail from said bracket.

3. An overhead mounting bracket according to claim 2 further characterized in that said disengaging face includes a tapered portion at a lower end thereof adapted to initially engage a return rib when a headrail is forced into contact with the decoupler means to force the return rib outwardly of the headrail.

4. An overhead mounting bracket according to claim 3 further characterized in that means are provided for limiting pivotal movement of said pivotal portion upon disengagement of a headrail from said bracket.

5. An overhead mounting bracket according to claim 1 further characterized in that the bottom of each said first and second leg portion has a tapered face for initially engaging the return ribs of a headrail and spreading the legs of the headrail apart when a headrail is forced into engagement with the first and second leg portions whereby the return ribs may be forced over said support shelves on mounting of a headrail to the bracket.

6. An overhead mounting bracket according to claim 1 further characterized in that said body portion includes mounting means for mounting said bracket to a frame.

* * * * *